US006219429B1

(12) United States Patent
Chung

(10) Patent No.: US 6,219,429 B1
(45) Date of Patent: Apr. 17, 2001

(54) CONNECTION SEAT FOR MOUNTING A MICROPHONE FOR EXCLUSIVE USE ALONG WITH MUSICAL INSTRUMENT

(75) Inventor: Ming-Cheng Chung, Ta-Li (TW)

(73) Assignee: Taky Electronics Co., Ltd., Ta-Li (TW)

( * ) Notice: Subject to any disclaimer, the term of this patent is extended or adjusted under 35 U.S.C. 154(b) by 0 days.

(21) Appl. No.: 09/394,269

(22) Filed: Sep. 10, 1999

(51) Int. Cl.[7] ..... H04R 25/00
(52) U.S. Cl. ..... 381/363; 381/361; 248/324
(58) Field of Search ..... 381/361, 362, 381/363, 364, 366, FOR 147, FOR 148; 248/324, 311.2, 313

(56) References Cited

U.S. PATENT DOCUMENTS 3,924,083 * 12/1975 Hagey ..... 381/363
4,514,598 * 4/1985 Plice ..... 381/361
4,527,019 * 7/1985 Lemp ..... 381/361

* cited by examiner

*Primary Examiner*—Stella Woo
*Assistant Examiner*—Suhan Ni
(74) *Attorney, Agent, or Firm*—Jiawei Huang; J. C. Patents

(57) ABSTRACT

A microphone connection seat is formed of a main body, a receptacle mount fastened fixedly with the main body, and a receptacle body fastened with the receptacle mount such that the receptacle body can be swiveled. The main body is provided with a threaded hole, which is intended to engaged a microphone stand. The receptacle body is provided with a plug receptacle. The receptacle body can be swiveled and located, thereby preventing the plug from being interfered by the microphone stand.

3 Claims, 6 Drawing Sheets

CONNECTION SEAT FOR MOUNTING A MICROPHONE FOR EXCLUSIVE USE ALONG WITH MUSICAL INSTRUMENT

FIELD OF THE INVENTION

The present invention relates to a connection seat for mounting a microphone which is exclusively used in conjunction with a musical instrument.

BACKGROUND OF THE INVENTION

The microphones are often used in the concert to amplify the sounds produced by various musical instruments, such as tom-toms, cymbals, etc. As shown in FIG. 1, a microphone connection seat 1 of the prior art is provided with a threaded hole 2 and a plug receptacle 3 contiguous to the threaded hole 2. The microphone is mounted on a stand 4 such that the threaded hole 2 of the microphone connection seat 1 is engaged with a threaded rod of the stand 4. In view of the plug receptacle 3 being contiguous to the threaded hole 2, the plug can not be inserted into the receptacle 3 after the microphone is mounted on the stand 4. Now referring to FIG. 2, the microphone connection seat 1 of the prior art is shown comprising an extension rod 5, which is provided at the top end thereof with a threaded projection 6 engageable with the threaded hole 2 of the microphone connection seat 1, and is further provided at the bottom end thereof with a threaded hole 7 engageable with the threaded rod of the stand 4. In view of the extension rod 5, the stand 4 is prevented from interfering the plug, thereby enabling the plug to be inserted into the receptacle 3 of the microphone connection seat 1.

Such a microphone connection seat 1 of the prior art as described above is defective in design in that the addition of the extension rod 5 results in an increase in the cost as well as the time that is required for mounting the microphone on the extension rod 5, the deficiency of the microphone connection seat 1 may be overcome by increasing the distance between the threaded hole 2 and the receptacle 3.However, an increase in the distance between the threaded hole 2 and the receptacle 3 results in an increase in volume of the microphone connection seat 1. It is conceivable that a large microphone connection seat looks awkward.

SUMMARY OF THE INVENTION

The primary objective of the present invention is to provide a microphone connection seat which is free from the drawbacks of the microphone connection seats of the prior art described above.

It is another objective of the present invention to provide a microphone connection seat with a plug receptacle which can be swiveled and located.

In keeping with the principle of the present invention, the foregoing objectives of the present invention are attained by a microphone connection seat comprising a main body, a receptacle mount, and a receptacle body. The main body is provided with a threaded hole engageable with a microphone stand. The receptacle body is fastened with the receptacle mount such that the receptacle body can be swiveled and located, thereby preventing the plug form being interfered by the microphone stand.

The foregoing objectives, features, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

As shown in FIGS. 3–6, a microphone connection seat embodied in the present invention comprises a main body 10, a receptacle mount 11, and a receptacle body 14.

Figure 1:
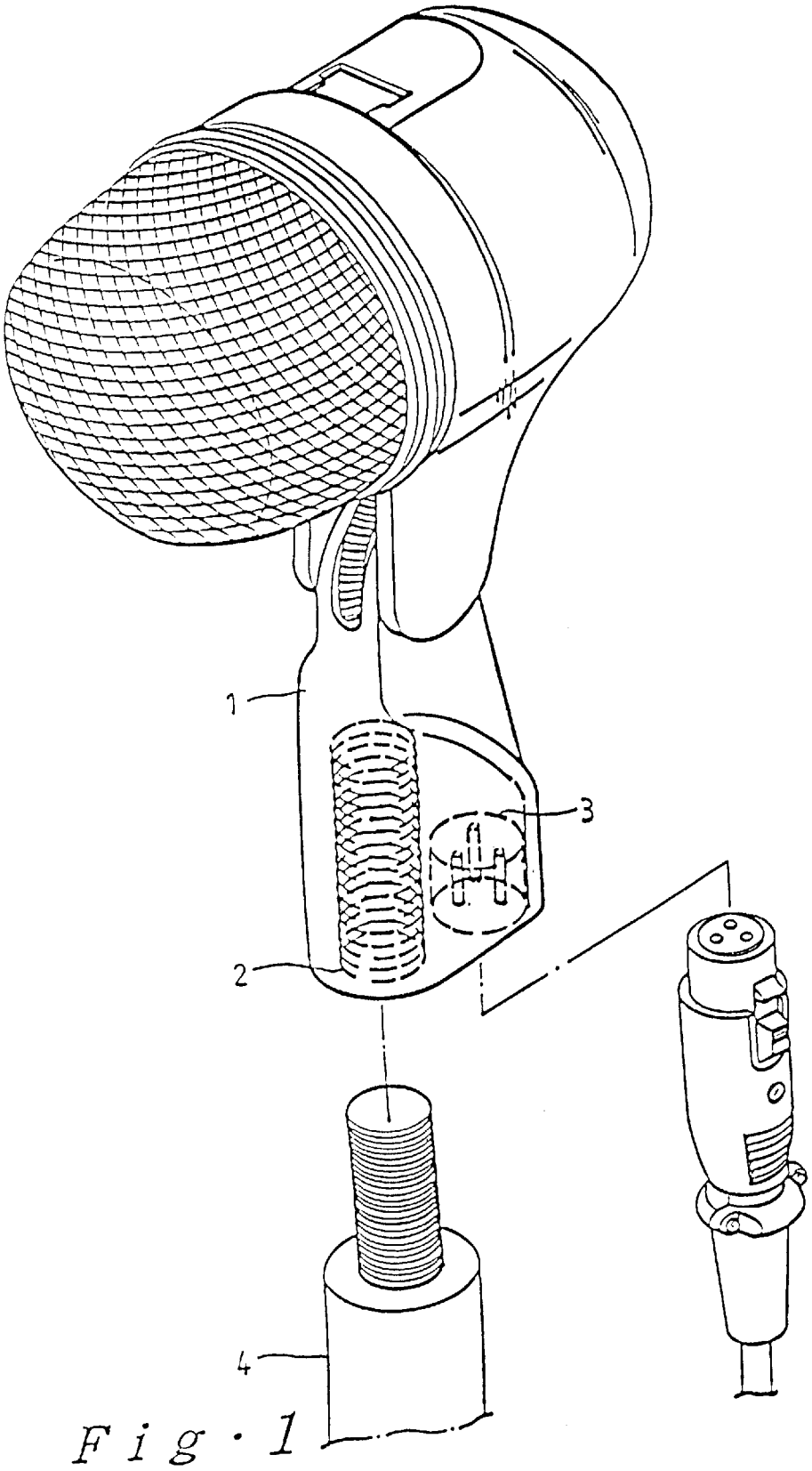
Fig. 1 PRIOR ART
FIG. 1 shows a schematic view of a microphone connection seat of the prior art.
Figure 2:
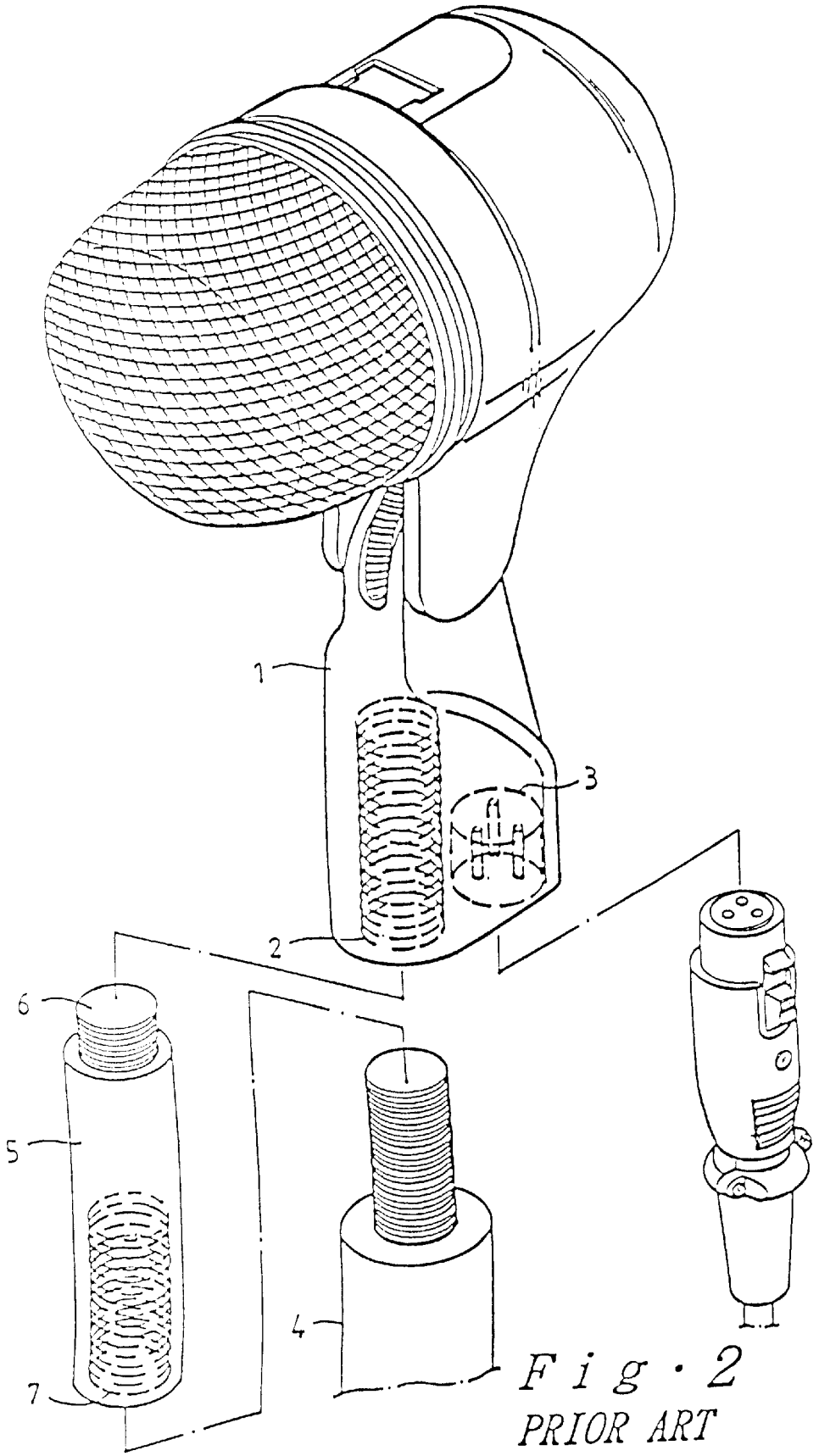
Fig. 2 PRIOR ART
FIG.2 shows a schematic view of another microphone connection seat of the prior art.
Figure 3:
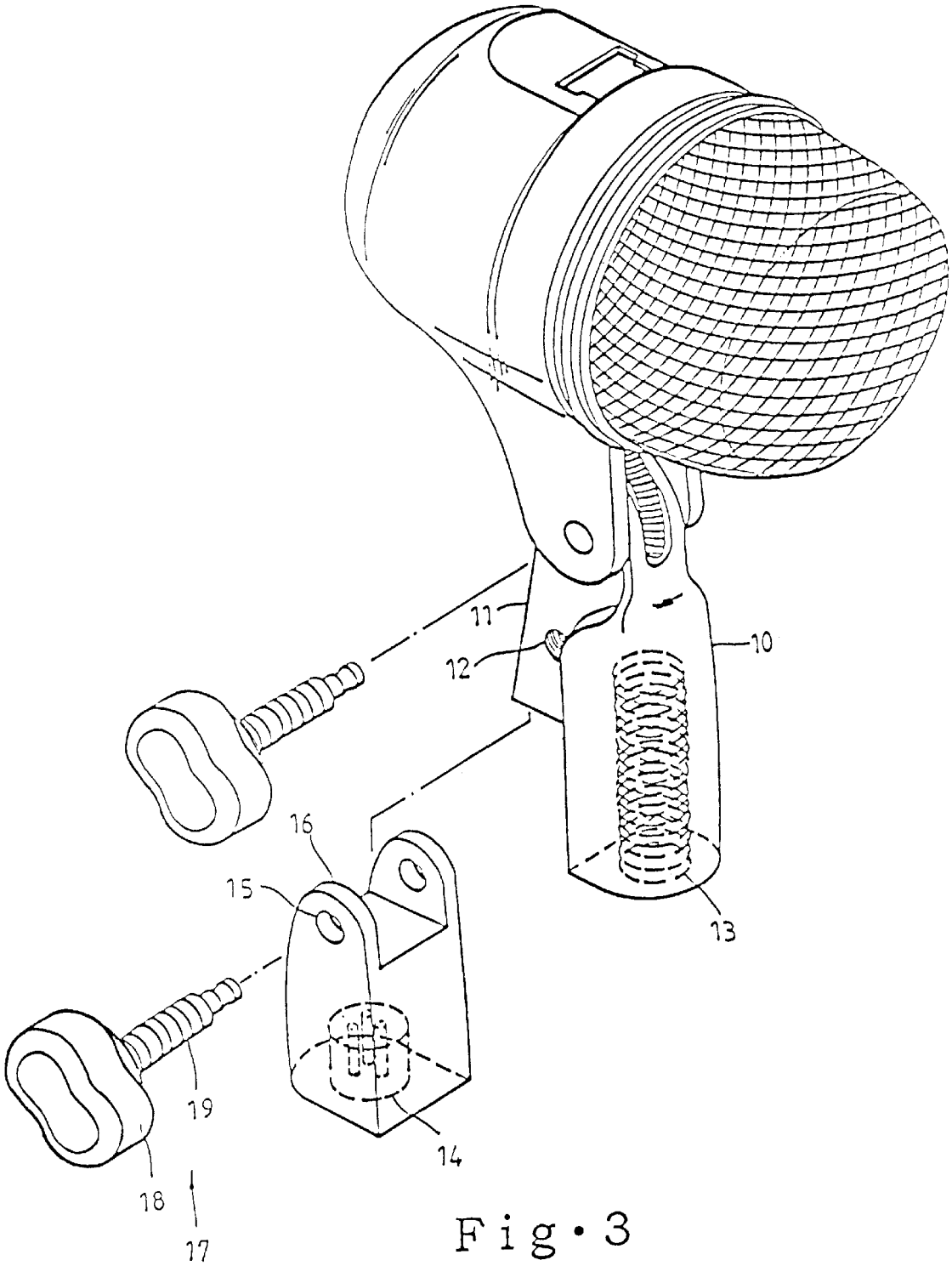
FIG.3 shows a partial exploded view of a microphone connection seat of the preferred embodiment of the present invention.
Figure 4:
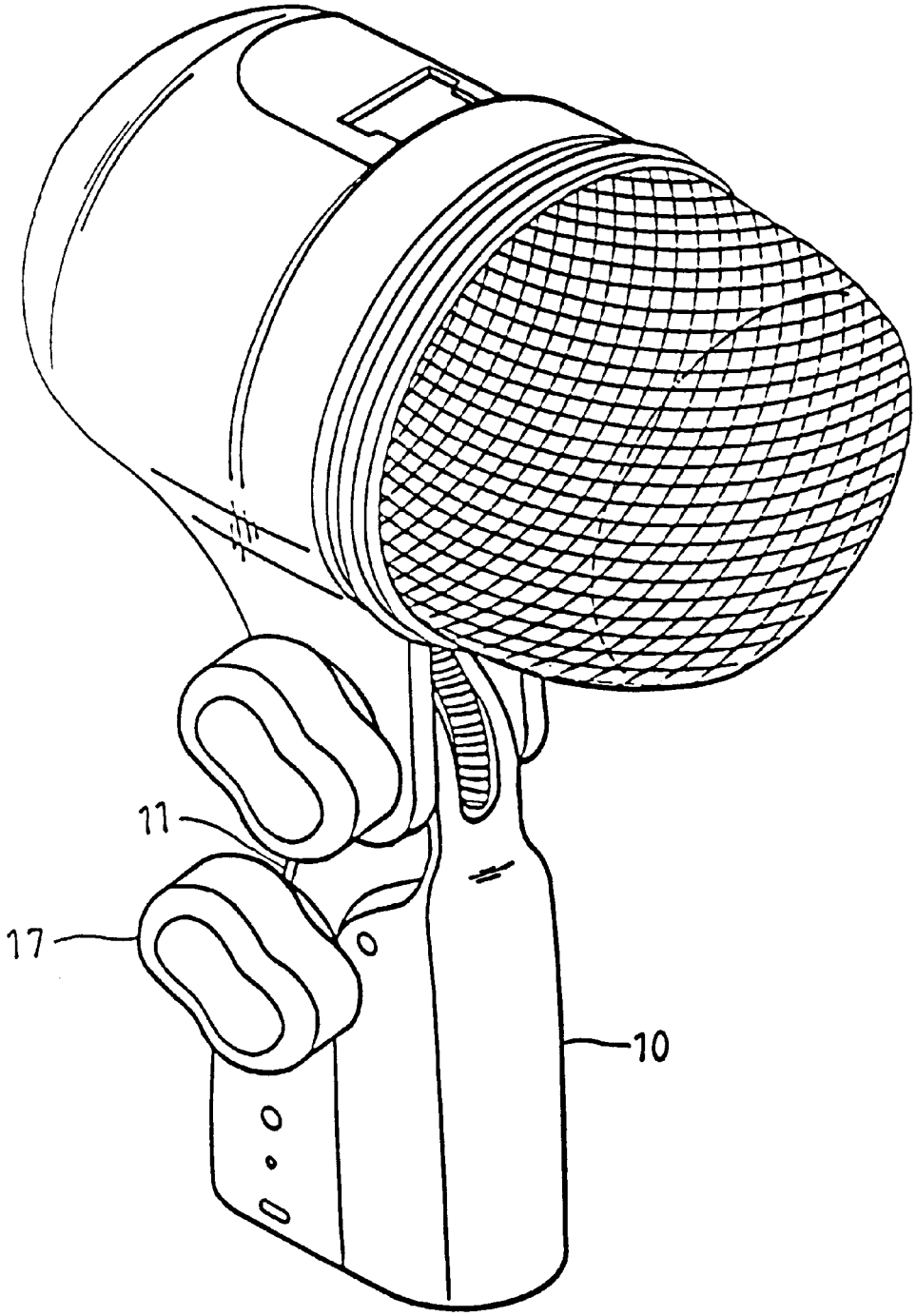
FIG.4 shows a perspective view of the microphone connection seat of the preferred embodiment of the present invention in combination.
Figure 5:
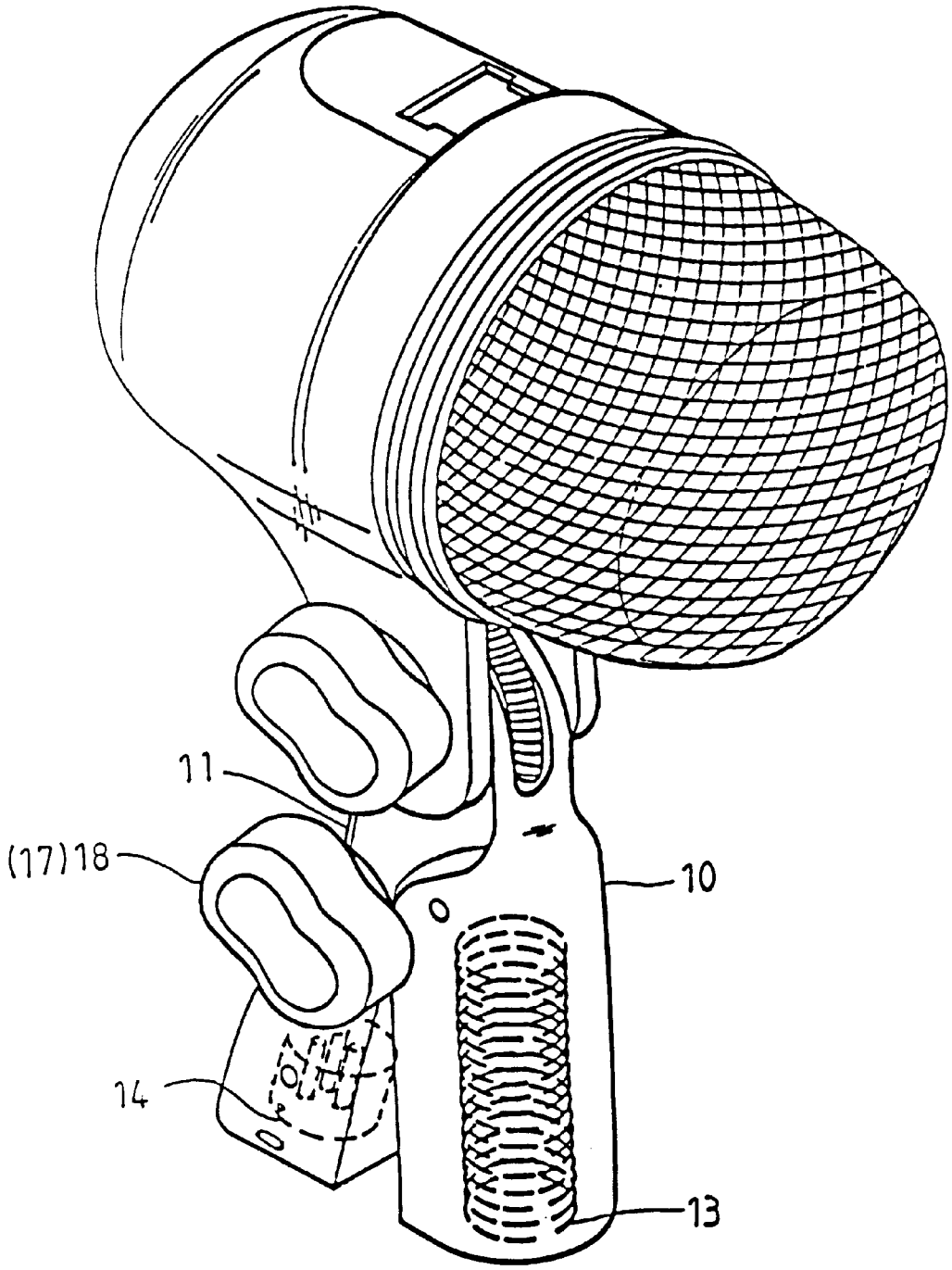
FIG.5 shows a schematic view of the microphone connection seat of the preferred embodiment of the present invention at work.
Figure 6:
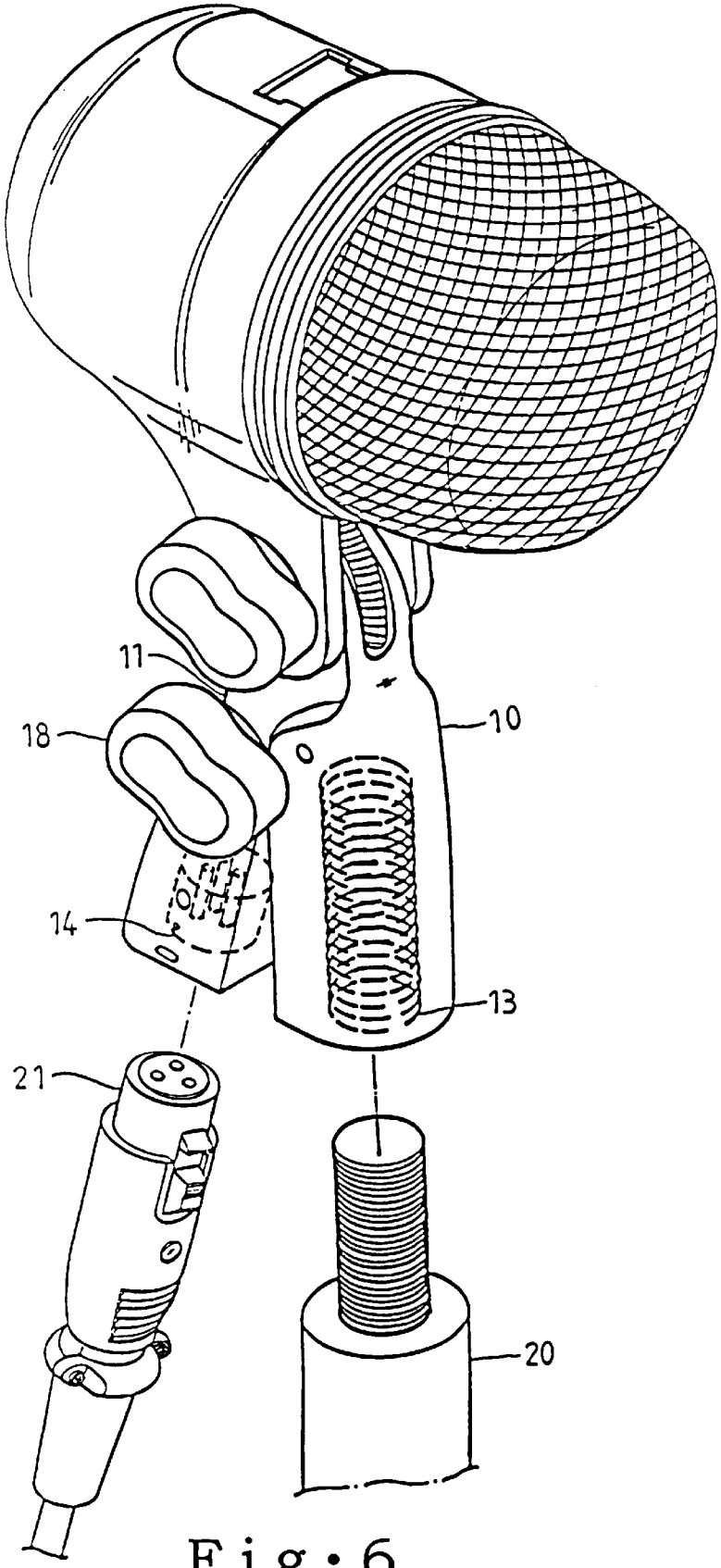
FIG.6 shows a schematic view of the present invention in conjunction with a plug and a microphone stand.

The main body 10 is provided with a threaded hole 13 engageable with the threaded rod of a microphone stand 20, as shown in FIG.6.

The receptacle mount 11 is provided with a threaded through hole 12. The receptacle mount 11 is fixed with the main body 10.

The receptacle body 14 is provided at the bottom end thereof with a receptacle for receiving a plug 21. The receptacle body 14 is further provided at the top end thereof with two lugs 16, each having a through hole 15. The receptacle body 14 is fastened with the receptacle mount 11 by a fastening bolt 17 such that the receptacle mount 11 is located between the two lugs 16 of the receptacle body 14, and that a threaded shank 19 of the fastening bolt 17 is received in the through holes 15 of the two lugs 16 of the receptacle body 14, and further that the threaded shank 19 of the fastening bolt 17 is engaged with the threaded hole 12 of the receptacle mount 11, and further that the receptacle body 14 can be swiveled on the fastening bolt 17. The fastening bolt 17 is provided with a head 18 which is intended to facilitate the locating of the receptacle body 14 after the receptacle body 14 is swiveled as desired. As the head 18 of the fastening bolt 17 is turned, the receptacle body 14 is located. The receptacle body 14 can be loosened by turning the head 18 in reverse.

The receptacle body 14 is swiveled to an extent that the plug receptacle of the receptacle body 14 is so located as to prevent the plug 21 form being interfered by the microphone stand 20. As a result, the plug 21 is inserted into the plug receptacle of the receptacle body 14 with ease and speed.

The embodiment of the present invention described above is to be regarded in all respects as being merely illustrative and not restrictive. Accordingly, the present invention may be embodied in other specific forms without deviating from the spirit thereof. For example, the plug receptacle may be located in the main body 10 instead of the receptacle body 14, whereas the threaded hole 13 is located in the receptacle body 14. The present invention is thereof to be limited only by the scopes of the following appended claims.

What is claimed is:

1. A microphone connection seat comprising:

a main body provided with a threaded hole which is engaged with a microphone stand;

a receptacle mount fastened fixedly with said main body and provided with a through hole; and a receptacle body provided at one end thereof with a plug receptacle and at other end thereof with two lugs, each having a through hole whereby said receptacle body is fastened with said receptacle mount by a fastening bolt such that said receptacle body can be swiveled on said fastening bolt which is received in said through hole of said receptacle mount and said through holes of said two lugs of said receptacle body.

2.The microphone connection seat as defined in claim 1, wherein said main body is provided with a plug receptacle; and wherein said receptacle body is provided at one end thereof with a threaded hole which is engaged with a microphone stand, said receptacle body further provided at other end thereof with two lugs, each having a through hole whereby said receptacle body is fastened with said receptacle mount by a fastening bolt such that said receptacle body can be swiveled on said fastening bolt which is received in said through hole of said receptacle mount and said through holes of said two lugs of said receptacle body.

3. The microphone connection seat as defined in claim 1, wherein said through hole of said receptacle mount is a threaded through hole; and wherein said fastening bolt has a threaded shank which is engaged with said threaded through hole of said receptacle mount such that said receptacle mount is located by turning said fastening bolt whereby said fastening bolt has a head to facilitate the turning of said fastening bolt.

* * * * *